US010219974B2

(12) United States Patent
Blenk et al.

(10) Patent No.: US 10,219,974 B2
(45) **Date of Patent: *Mar. 5, 2019**

(54) MASSAGE DEVICE

(71) Applicants: Udo Blenk, Berlin (DE); Stefan Stohr, Berlin (DE)

(72) Inventors: Udo Blenk, Berlin (DE); Stefan Stohr, Berlin (DE)

( * ) Notice: Subject to any disclaimer, the term of this patent is extended or adjusted under 35 U.S.C. 154(b) by 387 days.

This patent is subject to a terminal disclaimer.

(21) Appl. No.: 14/843,713

(22) Filed: Sep. 2, 2015

(65) Prior Publication Data

US 2016/0015595 A1 Jan. 21, 2016

Related U.S. Application Data

(63) Continuation-in-part of application No. 12/999,341, filed as application No. PCT/DE2009/000839 on Jun. 16, 2009, now Pat. No. 9,192,542.

(30) Foreign Application Priority Data

Jun. 16, 2008 (DE) ..... 10 2008 028 717

(51) Int. Cl.
*A61H 23/02* (2006.01)
*A61H 19/00* (2006.01)

(52) U.S. Cl.
CPC ..... *A61H 23/02* (2013.01); *A61H 19/34* (2013.01); *A61H 19/44* (2013.01); *A61H 23/0218* (2013.01); *A61H 2201/0153* (2013.01)

(58) Field of Classification Search
CPC ..... A61H 19/44; A61H 23/02; A61H 19/34; A61H 2201/0153; A61H 23/0218
See application file for complete search history.

(56) References Cited

U.S. PATENT DOCUMENTS 2,943,621 A 7/1960 Phillips
3,991,751 A 11/1976 O'Rourke
(Continued)

FOREIGN PATENT DOCUMENTS

CN 85205738 12/1986
CN 2166809 6/1994
(Continued)

OTHER PUBLICATIONS https://en.wikipedia.org/wiki/paperboard cited Jun. 23, 2017, 5 pages.

*Primary Examiner* — Christine H Matthews
(74) *Attorney, Agent, or Firm* — Karin L. Williams; Mayer & Williams PC

(57) ABSTRACT

A massage device includes a device housing, with an electromechanical arrangement arranged in the housing for generating mechanical vibrations, along with an electronic controller arranged in the housing for activating the arrangement for generating mechanical vibrations, and with a power source, connected to the arrangement for generating mechanical vibrations and the electronic controller. The arrangement for generating mechanical vibrations includes at least one coil element and at least one ferromagnetic core arranged parallel or coaxial with the coil element and movably guided parallel to a cylinder axis, characterized in that the at least one ferromagnetic core has a mass m1, the mass ratio m1:m2 of which to the total mass m2 of the massage device is in the range from 1:100 to 1:3.

41 Claims, 3 Drawing Sheets

(56) References Cited

U.S. PATENT DOCUMENTS

| | | | | |
|---|---|---|---|---|
| 4,377,692 | A | 3/1983 | Barry et al. | |
| 4,697,581 | A | 10/1987 | Endo et al. | |
| 5,434,549 | A | 7/1995 | Yasuyuki | |
| 9,192,542 | B2 * | 11/2015 | Blenk | A61H 23/02 |
| 2002/0156402 | A1 | 10/2002 | Woog et al. | |
| 2008/0001484 | A1 | 1/2008 | Fuller | |
| 2011/0144426 | A1 | 6/2011 | Blenk | |
| 2012/0172661 | A1 | 7/2012 | Chiu | |
| 2013/0197302 | A1 | 8/2013 | Levy | |
| 2014/0243589 | A1 | 8/2014 | Rowan | |

FOREIGN PATENT DOCUMENTS

| | | | |
|---|---|---|---|
| CN | 2375027 | | 4/2009 |
| DE | 2310862 | | 9/1974 |
| DE | 2437053 | A1 | 2/1976 |
| DE | 19615557 | | 10/1997 |
| DE | 29913641 | | 3/2000 |
| DE | 102005042092 | | 10/2007 |
| DE | 10 2008 016959 | A1 | 11/2009 |
| FR | 2887144 | | 12/2006 |
| JP | H11168869 | | 6/1999 |
| JP | 2005-348815 | | 12/2005 |
| WO | 00/23030 | | 4/2000 |
| WO | 2005/041845 | | 5/2005 |
| WO | 2009152813 | | 6/2009 |

* cited by examiner

MASSAGE DEVICE

CROSS REFERENCE TO RELATED APPLICATIONS

This application is a continuation-in-part of U.S. application Ser. No. 12/999,341, filed Feb. 28, 2011, now U.S. Pat. No. 9,192,542, which is a 371 of International Application No. PCT/DE2009/000839, filed Jun. 16, 2009 and claims priority to German Application No. 102008028717.2, filed Jun. 16, 2008. The applications are incorporated herein by reference.

FIELD OF THE INVENTION

The invention relates to a massage device, in particular for sexual stimulation, comprising an essentially cylindrical housing, with electromechanical means arranged in the housing for generating mechanical vibrations, along with electronic means arranged in the housing for activating the means for generating mechanical vibrations and with a power source, connected to the means for generating mechanical vibrations and the electronic means, wherein the means for generating mechanical vibrations comprise at least one coil element and at least one ferromagnetic core arranged parallel or coaxial with the coil element and movably guided parallel to a cylinder axis of the housing. Furthermore, the invention relates to the use of such a massage device for sexual stimulation.

PRIOR ART AND BACKGROUND OF THE INVENTION

Massage devices for sexual stimulation are for instance known from the documents U.S. Pat. No. 3,991,751 and U.S. Pat. No. 4,377,692. These are essentially devices replicating the shape and appearance of a male phallus, comprising means integrated therein for generating mechanical vibrations.

In the insofar known massage devices, the means for generating mechanical vibrations typically comprise an electric motor, on the shaft of which a vibration element with an unbalanced mass is attached. Thereby, by rotation of the electric motor, a vibration is generated usually extending orthogonal to the longitudinal extension of the housing, since the shaft of the electric motor is arranged parallel to the housing axis. In the insofar known massage devices, vibrations with relatively high frequency and with low amplitude are produced. Further, a disturbing noise with the frequency of the vibrations occurs in most cases. All this is disadvantageous for the use of the massage device, since this will be regarded as rather annoying.

Massage devices of the type of construction mentioned above are for instance known from the documents DE 29913641 U1, DE 2310862 A and DE 19615557 A1. In the first document above, the means for generating mechanical vibrations are loudspeaker elements, the loudspeaker axis of which is parallel to or coaxial with the cylinder axis of the housing. Because of the use of loudspeakers, the generated vibrations have a relatively high frequency with minimum amplitude in the direction of the cylinder axis. In the subject matter of the DE 19615557, only a front end of the housing is set into vibrations and not the complete housing. Thus, the massage effect is rather low. In the subject matter of the document DE 2310862, the direction of the vibrations is not clear.

For massage devices for the above purposes, it is generally desirable that on the one hand the massage device itself vibrates as a whole, that on the other hand these vibrations have a relatively high amplitude, and finally that the vibrations take place in the directions parallel to the housing axis of the cylindrical housing, since this results in an appreciably improved massage effect. Further, it is desirable that such a massage device can be operated very silently, preferably practically inaudibly.

Various devices comprising vibration generators are known from the documents US 2002/0156402, U.S. Pat. No. 4,697,581, WO2009/152813, CN-2166809, JP-2005-348815, and CN-85205738.

Technical Object of the Invention

It is therefore the technical object of the invention to specify a massage device, which as a whole carries out vibrations of relatively high amplitude in the directions parallel to the housing axis, and with a low frequency and practically noiseless at that.

BASICS OF THE INVENTION AND PREFERRED EMBODIMENTS

For achieving this technical object, the invention relates in a first aspect to a massage device comprising a device housing, an electromechanical arrangement disposed in the device housing for generating mechanical vibrations, an electronic controller for controlling the electromechanical arrangement for generating mechanical vibrations, and a power source, electrically coupled to the electromechanical arrangement and the electronic controller, wherein the electromechanical arrangement includes at least one coil element, at least one magnetic core arranged parallel or coaxial with the coil element and movably guided parallel to a cylinder axis of the housing, wherein the core has a mass m1 and the massage device has a total mass m2, wherein a mass ratio m1:m2 is in the range from 1:100 to 1:3.

According to a second aspect a massage device is taught, comprising a device housing, an electromechanical arrangement disposed in the device housing for generating mechanical vibrations, an electronic controller for controlling the electromechanical arrangement for generating mechanical vibrations, and a power source, electrically coupled to the electromechanical arrangement and the electronic controller, wherein the electromechanical arrangement includes a linear actuator comprising a stator and a moveable and permanently magnetized core, wherein the core is movably guided parallel to a cylinder axis of the housing and wherein the stator is operatively controlled by the electronic controller to effect the core to sway back and forth between two end points of linear movement periodically, and wherein the core has a mass m1 and the massage device has a total mass m2, wherein a mass ratio m1:m2 is in the range from 1:100 to 1:3.

A third aspect relates to a massage device comprising: a device housing, an electromechanical arrangement disposed in the device housing for generating mechanical vibrations, an electronic controller for controlling the electromechanical arrangement, and a power source, electrically coupled to the electromechanical arrangement and the electronic controller, wherein the electromechanical arrangement includes at least one coil element and at least one ferromagnetic core, wherein the core has a mass m1 and the massage device a total mass m2, wherein a mass ratio m1:m2 is in the range from 1:100 to 1:3, and wherein the electromechanical arrangement further comprises: a cylindrical member, in which at least one ferromagnetic core is guided parallel to a cylindrical member axis; the at least one coil element having a coil axis arranged coaxial with the cylindrical member and surrounding the cylindrical member; and one impact element located at each end of the cylindrical member, wherein the impact member effects a repulsive force on a face of the core facing the impact element.

A fourth aspect is characterized by a massage device comprising a device housing, an electromechanical arrangement disposed in the device housing for generating mechanical vibrations, an electronic controller for controlling the electromechanical arrangement for generating mechanical vibrations, and a power source, electrically coupled to the electromechanical arrangement and the electronic controller, wherein upon activation of the electromechanical arrangement the massage device as a whole vibrates with a frequency in the range between 0.3 to 10 Hz and an amplitude of vibration in the range from 5 to 50 mm.

By dimensioning the mass ratios according to the invention, it is on the one hand achieved that the massage device, caused by its inertia, will as a whole carry out a vibration in the directions parallel to the cylinder axis of the housing, and with a substantial amplitude at that. Furthermore, the means used according to the invention for generating mechanical vibrations can be operated practically inaudibly and in frequency ranges being advantageous for massage purposes. Finally, the massage movements of a massage device according to the invention correspond to rather natural movements compared to prior art massage devices.

It is preferred if the mass ratio m1:m2 is in the range from 1:50 to 1:3, in particular 1:20 to 1:3 or 1:10 to 1:3 or 1:5. In these connections it is useful if the mass m1 is in the range from 10 to 300 g, preferably 15 to 200 g, most preferably 10 to 100 g or 20 to 80 g. For the purpose of the invention it is preferred if the amplitude of the cores in the directions parallel to the cylinder axis is in the range from 5 to 150 mm, preferably 10 to 100 mm, most preferably 10 to 60 mm.

Further, it is preferred for the purpose of the invention if the electronic means activate the means for generating mechanical vibrations with a frequency in the range from 0.1 to 50 Hz, preferably 0.1 to 20 Hz, most preferably 0.3 to 10 Hz, in particular 0.3 to 5 or to 10 Hz.

For all above parameters, the lower and/or upper limits of the different ranges of the same parameter can however also be combined in an arbitrary manner.

A cylindrical member is provided wherein the magnetic core is movably guided, wherein the cylindrical member may include an end magnet at each end thereof, wherein the magnetic polarity of an inner face of an end magnet is the same as the magnetic polarity of an end face of the core facing the inner face of an end magnet.

The form of the device housing may be of essentially cylindrical, spherical, conical, or cylindrical with one or more necking, shape.

The device housing may include an overcoat made of a physiologically compatible material. The overcoat is e.g. made from silicone, latex, polyolefines, synthetic polyisoprene, polyurethane, nitrile rubber, synthetic resin AT-10, hydrogel, graphen, or natural casing.

The power source may be an accumulator. Then the electronic controller may additionally comprise an electronic charging circuit for the accumulator. The electronic charging circuit for the accumulator may be provided externally as a separate charging device and electrically connected to the massage device by a charging lead, wherein the charging lead comprises a contacting member, which is reversibly connectable with charging contacts arranged on or in a surface of the massage device. Alternatively the electronic charging circuit may be inductively connected to the massage device by an inductive power transmitter, wherein the charging circuit comprises an inductive power receiver, which is reversibly introducible into an inductive field of the inductive power transmitter. The power source may just as well be a battery. The power source may even be a mains adaptor, wherein the mains adaptor comprises a detachable or permanent mains line for connecting to a mains socket.

The cylindrical member may be made of an synthetic organic polymer, a metal with a magnetic permeability of less than 3 $V*s*A^{-1}*m^{-1}$, or a material on the basis of paper or cardboard.

The total mass m2 of the massage device comprises the masses of the device housing, of the electromechanical arrangement, of the electronic controller, of the battery or accumulator, and of the overcoat.

At least a part of the outer surface of the device housing may have a topography comprising riffles and/or pimples.

All electrical components comprised therein may be located in waterproof compartments. In particular, the battery or the accumulator may be located in a waterproof compartment located within the massage device.

The device housing may be made of an organic polymer having a mechanical strength and dynamic stiffness of the mechanical strength and dynamic stiffness of polyethylene at least.

The massage device may further comprise at least one control assembly operatively coupled to the electronic controller to adjustably control a frequency and/or amplitude of mechanical vibrations of the core. The control assembly may be a wireless or wire-bound remote control assembly. The control assembly may comprise at least one control member located on or in a surface of the device housing, which is operatively coupled to the electronic controller to vary the frequency and/or amplitude upon actuations of the control member. The electronic controller may comprise a memory circuit, into which different programs with respect to different amplitudes and/or frequencies of the core are stored. The electronic controller may comprise a control member which is operatively coupled to the memory circuit to activate different programs upon actuation of the control member.

The massage device may further comprise two control members for independent variation of a frequency and an amplitude of mechanical vibrations of the core. The control member may be a pushbutton, which is operatively connected to the control assembly to vary the frequency and/or amplitude of the vibrations of the core upon repeated actuations of the pushbutton.

In principle, the means for generating mechanical vibrations can be freely configured. Any electromechanical linear drive, which can be controlled with regard to direction, amplitude and frequency according to the above parameters, can be used. It is preferred, however, if the means for generating mechanical vibrations comprise: a cylindrical member, in which the core is arranged parallel to a cylindrical member axis, in particular coaxial with the cylindrical member axis, at least one excitation coil, the coil axis of which is arranged coaxial with the cylindrical member and surrounds the cylindrical member, and one elastically deformable impact element each at each end of the cylindrical member and in the interior thereof. The cylindrical member axis is essentially parallel or coaxial with the cylinder axis of the housing. It is a matter of course that the cylindrical member is suitably made of materials, the magnetic permeability of which is smaller than 10, in particular than 2. For this purpose, for instance materials made of organic polymers can be used, but also metal materials, such as for instance aluminum. The core may be just ferromagnetic, it may however also be (permanently or non-permanently) magnetized. The elastically deformable impact elements in the interior of the cylindrical member and at its ends limit the amplitude of the cores and attenuate its impact at the ends of the cylindrical member. Practically all rubber-elastic materials can be used, however also essentially elastically deformable foams made of organic polymers.

Alternatively to impact elements, it may be provided that the core is suspended in a spring-elastic manner about a preferably central (referred to the cylindrical member) rest position. Both ends of the core can be connected in a friction-locked manner by a spring element with the ends of the cylindrical member. However, there may also be one spring element only that connects one end of the core with one end of the cylindrical member. Spring elements may in principle be all springs used in the field of mechanics, tension as well as compression springs, for instance helical springs made of metal or organic/polymeric materials, but also rubber-elastic bands and the like.

In a preferred embodiment, two excitation coils being coaxial with each other and spaced in the direction of the cylindrical member axis are provided. Energy is alternately applied to these coils, so that the core will be attracted in the opposite direction from the respective end position of the stroke. In the case of a magnetized core, the two coils are supplied with a polarity being opposed to the core.

Suitably, the cylindrical housing comprises an outer wall made of a physiologically compatible material. For this purpose, in principle all polymeric materials being usual in medical devices can be used, in particular also silicone plastic materials, latex, polyolefins and the like.

It is useful if an inner wall of the cylindrical member and/or an outer wall of the core has a slide coating. Thereby, static and sliding friction between core and inner wall of the cylindrical member are reduced, so that the energy demand of the coil is lower. For this purpose, basically all slide coatings being usual in mechanics can be used, wherein suitably static friction coefficients of $<0.2$ between the sliding surfaces are provided. An example for such a slide coating includes polyolefins and fluorinated hydrocarbons, in particular PTFE. Alternatively, it is of course also possible to guide the core in the cylindrical member by means of a linear roller bearing or the like. Instead of a slide coating, or additionally, conventional lubricants, liquid or paste-like, can also be used. Among these are in particular oils and greases based on hydrocarbon or silicone.

Suitably, the power source is a replaceable battery or accumulator. In the latter case, it is recommendable that the electronic means additionally comprise an electronic charging device for the accumulator, whereby the accumulator of the massage device can be recharged after use by a conventional power supply. For this purpose, the housing includes an electrical plug connection for connection of the charging device. Alternatively to a plug connection, means for wireless charging can be provided, for instance an induction loop integrated in the massage device. For charging, the massage device is then introduced into a charging station, which in turn comprises inductive means for supplying electrical energy.

It is further preferred, if the electronic means are connected with at least one control assembly, by means of which frequency and/or amplitude of the mechanical vibrations of the core can be adjusted and controlled in steps or continuously. These control assemblies can be arranged in or at the massage device or in the region of an end of the housing or of a front face of the housing and can be intended for manual control. In the simplest case, these are one or several rotary knobs, for instance potentiometers, but also up/down keys and the like are possible in particular in connection with a processor-controlled electronic system. Alternatively it is however also possible that control assemblies are arranged spaced from the housing and connected by wires or wireless with the electronic means. In the latter case, a receiver is integrated in the housing, said receiver being provided for the communication with a separate transmitter, and then the transmitter comprises the manually operable control assembly.

The term essentially cylindrical housing is not restricted to the exact cylindrical shape. Rather, the cross section may differ from the circular shape. Furthermore, the cylinder axis may be non-linear. Finally, at least one cylinder front face is preferably not plane, but rounded, and in particular for instance replicating the front end of a male phallus. Further, the outer surface of the housing may not only be smooth, but may comprise a topography, for instance with regular or irregular nubs.

BRIEF DESCRIPTION OF THE DRAWINGS

In the following, the invention is explained in more detail with reference to figures representing an example of execution only. There are.

DETAILED DESCRIPTION

Figure 1:
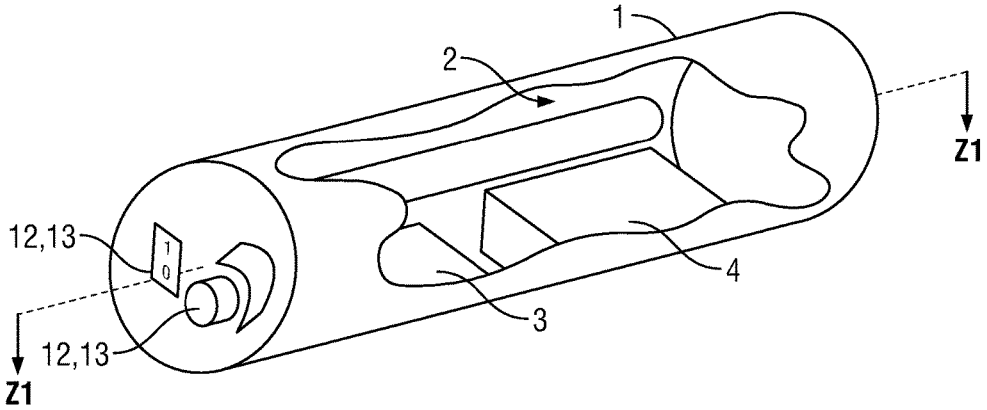
FIG. 1: an outside view of a massage device according to the invention, partially cut open.

In FIG. 1 can be seen that the massage device comprises an essentially cylindrical housing 1. In the housing 1, electromechanical means 2 for generating mechanical vibrations are arranged. Furthermore, the housing comprises electronic means 3 for activating the means 2 for generating mechanical vibrations. Finally, a power source 4 is provided in the housing 1, said power source being connected with the means 6 for generating mechanical vibrations and with the electronic means 3.

Figure 2:
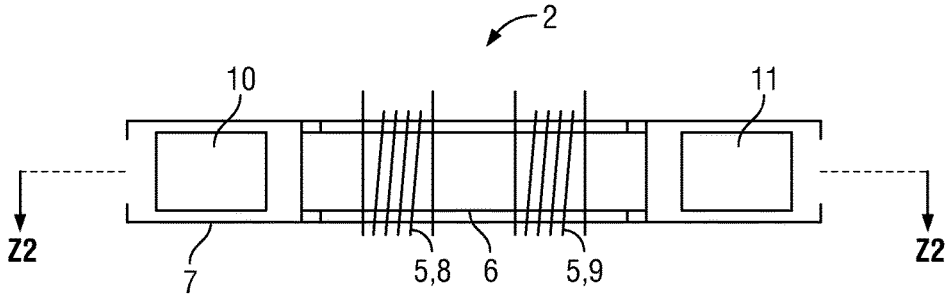
FIG. 2: a schematic cross section of a vibration generator used according to the invention.

From FIG. 2 can be taken that the means 2 for generating mechanical vibrations comprise at least one coil element 5, in the example of execution with excitation coils 8, 9, and a movably guided ferromagnetic core 6. In particular, a cylindrical member 7 is provided, which has a magnetic permeability of approx. 1, and in which the core 6 is guided parallel to a cylindrical member axis Z2.

A comparison of FIGS. 1 and 2 shows that the cylindrical member axis Z2 extends parallel to the cylindrical member axis Z1. Thereby, the core 6 moves parallel to the cylinder axis Z1 and is guided in the cylindrical member 7. Different from the representation of FIG. 1, the cylindrical member axis Z2 may also be coaxial with the cylinder axis Z1. From FIG. 1 can be further taken that a control assembly 12 adapted as a rotary knob is provided at one end of the housing 1, by means of which the frequency and/or amplitude of the mechanical vibrations of the core 6 can be adjusted and controlled. Furthermore, an on/off switch 13 is provided.

It is a matter of course for the purpose of the invention that the cylindrical member 7 is preferably rigidly connected with the housing 1. Thereby, the mechanical vibration of the core 6 is transferred in an optimum manner to the housing 1 as a whole.

Coming back to FIG. 2, it can be seen that two excitation coils 8, 9 being coaxial with each other and spaced in the direction of the cylindrical member axis Z2 are provided. Furthermore, elastically deformable impact elements 10, 11 arranged on the inner side and at each end of the cylindrical member 7 can be seen. In the case of a magnetized core 6, the two excitation coils 8, 9 are activated alternately and with opposed polarity by the electronic means 3. The impact elements 10, 11 are made for instance of a foam material.

A massage device according to the invention typically comprises a core 6 with a mass m1 in the range from 10 to 300 g, in particular 15 to 200 g, preferably 20 to 80 g. The total mass m2 of the massage device is typically in the range from 100 to 1,000 g, in particular from 150 to 500 g, preferably from 200 to 400 g. The electronic means 3 activate the means 2 for generating mechanical vibrations with a frequency typically in the range from 0.3 to 5 Hz. Then, typically, the activation of the excitation coils 8, 9 occurs with a rectangular function or a trapezoidal function with high edge steepness. Thereby, high accelerations of the core 6 and respective counter-movements of the housing 1 are induced. The amplitude H of the core 6 in the directions parallel to the cylinder axis is typically in the range from 5 to 150 mm. The amplitude H of the vibrating core 6 corresponds to the distance of the opposing surfaces of the impact elements 10, 11 minus the longitudinal extension of the core 6 in the direction of the cylindrical member axis Z2. Preferably, the amplitude is in the range from 20 to 80 mm.

Figure 3:
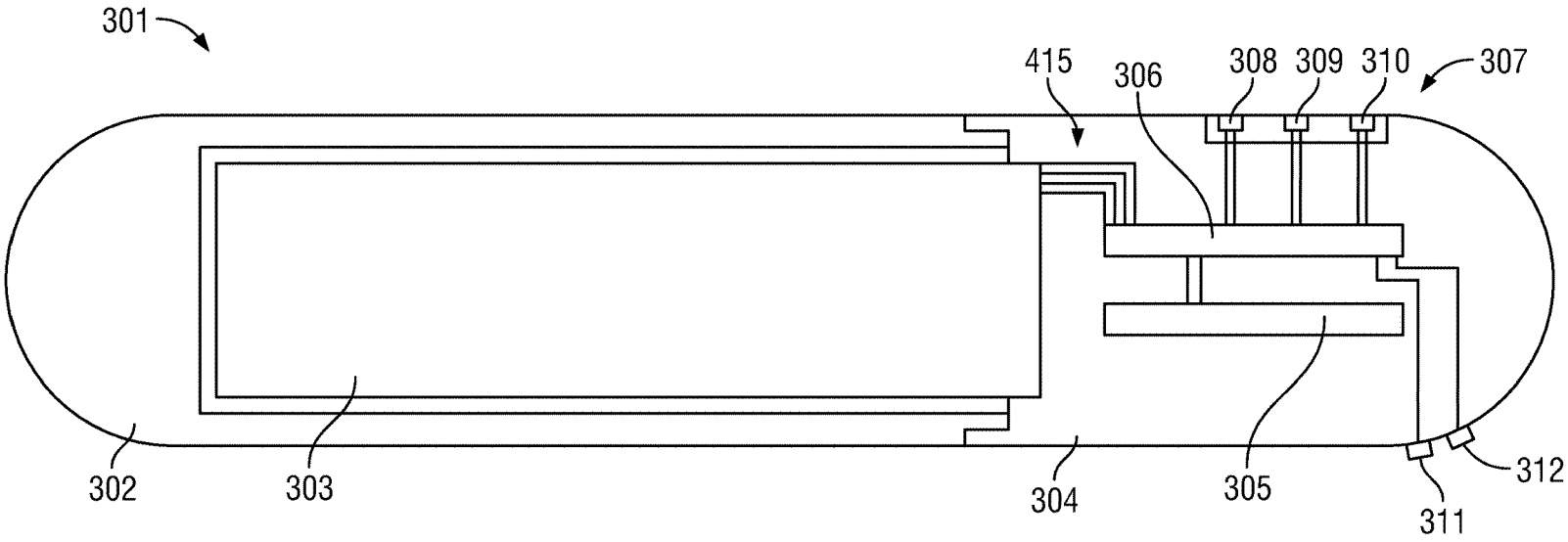
FIG. 3: an outside view of another massage device according to the invention.

FIG. 3 shows a massage device 301 in less schematic and more detailed manner. The massage device 301 comprises a two-part device housing consisting of a first housing 303 with a vibration generator and a second housing 304 in which various electronic components are located. The first housing 303 and the second housing 304 are rigidly joined together. Further evident is an overcoat 302 placed over the first housing 303. The overcoat 302 is made for example, from silicone rubber. This overcoat may have a topography (not shown) comprising riffles and/or pimples. The first housing 303 and the second housing 304 are made, in contrast, of a material with comparatively high mechanical strength and dynamic stiffness. First housing 303 is made of polyethylene and the second housing 304 is made of ABS.

The second housing 304 encloses an accumulator 305, an electronic controller 306, a control assembly 307 with push buttons 308, 309, 310 and contacting members 311, 312 for charging lead. At least the accumulator 305 and the electronic controller 306 are arranged in one single or in two separate water proof compartments located in the second housing 304.

The two contacting members 311, 312 are magnetized metallic contacts, wherein the magnetization is such that the outward surface of the contact members 311, 312 have opposite magnetic polarity. The charging lead of an electronic charging circuit (not shown) has a complementary set of contacting members by which it is ensured that the complementary contacting members only come in contact with the contacting member 311, 312, if placed with correct polarity. The external electronic charging circuit is typically plugged into a main socket for the purpose of charging the accumulator 305. The control assembly 307 is operatively coupled to the electronic controller 306. First push button 310 serves as a power on/power off push button. Each operation of push button 310 switches between one of these two modes. The push button 309 operatively controls the frequency and amplitude of mechanical vibrations of the vibration generator within the first housing 303. Each press on push button 309 increases the frequency and decreases the amplitude and increments programmably stored within the electronic controller 306. A total of 6 increments, for example, may be provided. If push button 309 is pressed after the highest frequency has been achieved, the program stored within electronic controller 306 provides for stepping back to the lowest frequency. The range of frequencies covered by all increments is between about 1 and 20 Hz. The push button 308 effects activation of different programs stored within the electronic controller 306. Such programs comprise predetermined variations of frequency and amplitude over the time. Within one single program, for example, the frequency may continuously increase and decrease again and so forth, over a predetermined time. Each press on the push button 308 activates a different program.

Upon operation the vibrations of the massage device 301 are practically inaudible due to specific design features explained in the context with the vibration generator, in particular due to the provision of end magnets 407, 408.

Figure 4:
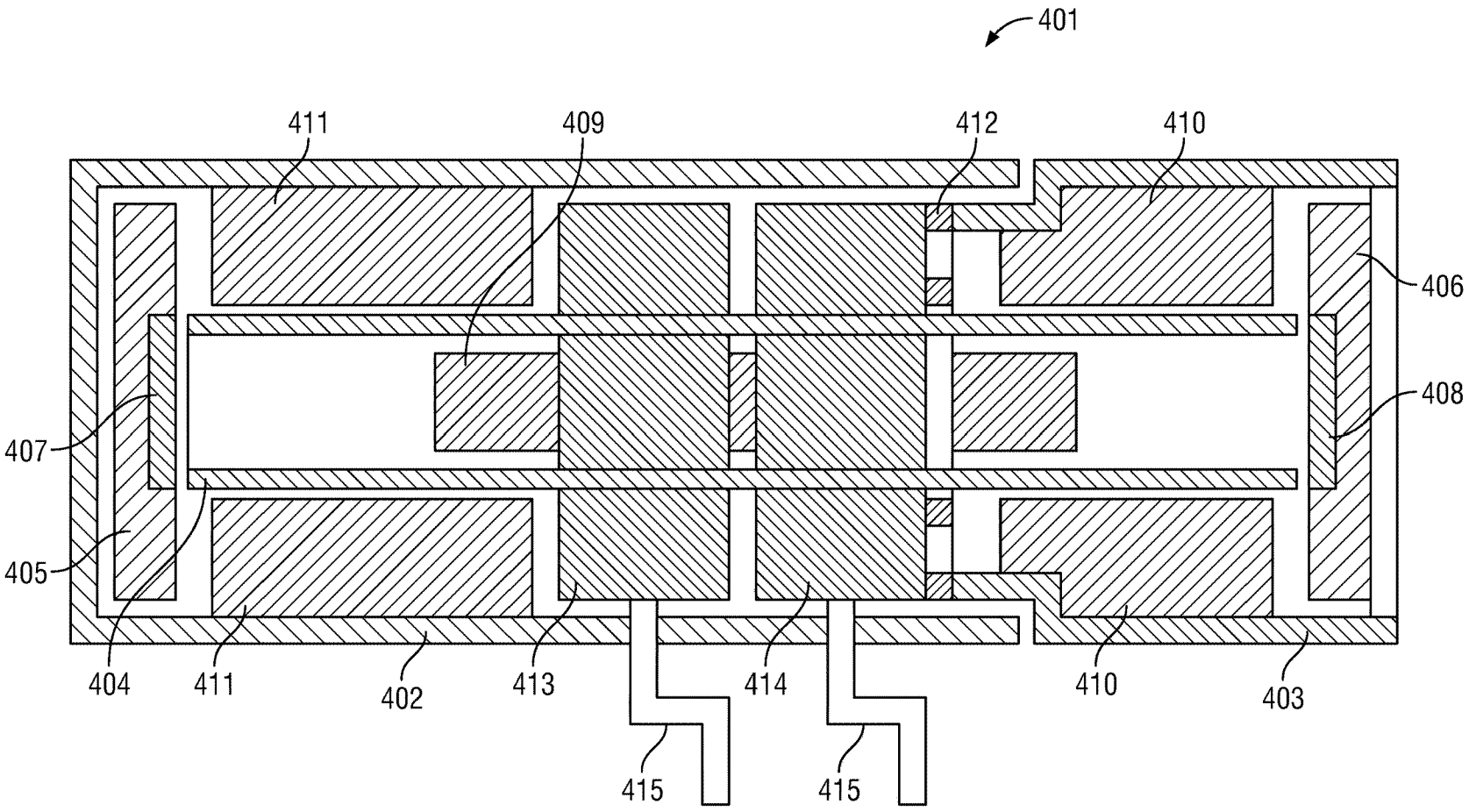
FIG. 4: details of the vibration generator shown in FIG. 3.

Turning to FIG. 4, therein essentially the first housing 303 with the internal functional components of the vibration generator are shown. This first housing is made of two housing parts 402, 403, which are of essentially cylindrical form and joined together coaxially. Both housing parts 402, 403 carry fins 410, 411 on their inner circumference and oriented radially. The ends of these fins 410, 411 support a cylindrical member 404, which is made of cardboard. Two coils 413, 414 are arranged as rings around the cylindrical member 404. One coil 413 is axially supported by the fins 411. The other coil 414 is axially supported by protrusions 412. Within the cylindrical member 404 a ferromagnetic core is placed and slidably guided by the cylindrical member 404. Opposite ends of the core typically has opposite magnetic polarity. The ends of the housing parts 402, 403 are closed with plugs 405, 406. These plugs 405, 406 carry end magnets 407, 408 on their inner side, wherein the end magnets 407, 408 are arranged coaxially to the cylindrical member 404 and the core 409. The end magnets 407, 408 act as impact members and their inward face has a magnetic polarity being the same magnetic polarity of the end face of the core facing this inner face of the end magnet. As a result the magnetic core 409 is repelled from the end magnets 407, 408. Each of the coils 413, 414 has to leads 415, which are fed through the first housing part 402 or the second housing part 403. In FIG. 4 the leads 415 are drawn in a less favorable way, just for the reason of a better representation. It is actually preferred to lead the leads 415 away in axial direction and through the second housing part 413 to emerge from the left side front face of the second housing part 403. This is shown in FIG. 3.

The mass ration of the mass of the core 409 (FIG. 4) to the total massage device 301 (FIG. 3) is about 1:5. This mass ration together with the described comparatively low vibration frequencies effects that the massage device as a whole moves back and forth with the frequency of the vibrating core 409.

In the following, the invention is once again explained in other words.

The aim of the invention is the design of a small, compact and mobile device that permits without mechanical coupling to the environment that the user can independently vary the movement components frequency and amplitude in the longitudinal direction of the rod-shaped massage device.

The massage device consists of the special device 1 that is accommodated in a housing that corresponds with regard to shape and material to the various usual vibrator housings.

It is the object of the invention to provide in a simple way a mobile device having the following features. Main components are the vibration generator and the electronic control system, advantageous embodiments result from the further explanations.

The object is essentially achieved by that the electronic control system supplies the coils of the vibration generator temporarily with electrical energy such that the magnetized armature is accelerated in such a manner that the forces thus generated set the massage device into the desired movement and as a result act sexually stimulating. The kind of the repeated movement is predetermined by the user by control elements.

The invention is explained in more detail with reference to an example of execution shown in the annexed drawings.

In FIG. 1 is shown an embodiment with a conventional housing of a massage device, which among others receives the vibration generator.

FIG. 2 shows a section of the vibration generator.

The massage device 12 acting in a massaging manner by oscillating, axial movements essentially consists of a housing 1, which houses in a first embodiment the vibration generator 2, the electronic control system 3, the control elements 12, 13 and the energy supply 4.

The oscillating, axial movement of the massage device is effected, according to the invention, by the vibration generator 2, by that the magnetized armature 6 is accelerated in the tube 7 by the magnetic field generated by the coils 8, 9. The forces caused by the acceleration of the armature 6 serve for generating an oscillating, axial movement of a massage device, by that the vibration generator 2 is attached in a positive-locked and friction-locked manner in the housing 1.

The vibration generator 2 consists in the shown embodiment of a plastic or metal tube 7 being partially closed at the ends, in which the magnetized armature 6 is supported in an axially movable manner. In the outer regions of the tube 7, spring-damper elements 10, 11 may be arranged, which promote the repeating movement of the armature about its rest position. The magnetized armature is accelerated by magnetic fields generated by the coils 8, 9. These coils 8, 9 are disposed on the outside of the tube, as is shown in FIG. 2. The distance of the coils 8, 9 is variable and results from the dimensions of the individual components of the vibration generator 2. The friction of the movable armature 6 in the tube 7 can be reduced by various usual methods, such as for instance by roller bearings and Teflon films. A particularly advantageous embodiment is that only one coil 8, 9 is arranged around the tube 7, which is addressed correspondingly by the electronic control system. In the shown embodiment, the armature 6 is a permanent magnet. An improvement of the device is that the magnetized armature 6 is an iron rod, which is magnetized by one or several solenoids and electrical energy.

By the control elements 12, 13, the user determines the kind of the oscillating, axial movement of the massage device. The electronic control system 3 activates the coils 8, 9 of the vibration generator such that the armature 6 is accelerated in a way that the generated translational movement of the massage device corresponds to the user settings. In the shown embodiment, a switch 13 for activating the device and a rotary knob 12 for varying the frequency or amplitude are at the user's disposal, as shown in FIG. 1.

By the switch 13, the circuit from the energy supply 4 via the electronic control system 3 to the coils 8, 9 is closed, and by the knob 12, the frequency or amplitude, respectively, can be adjusted, with which the armature 6 moves about the rest position. A particularly advantageous improvement is that the user can choose from a manifold series of pre-defined types of movements, as described, and the electronic control system addresses the coils in a way that the desired types of movements of the massage device are automatically generated. It is advantageous that by the vibration generator 2, the axial movements can be varied separately in frequency and generated amplitude at the device 13. For this purpose, the electronic control system specifies the respective chronological activation of the coils. As additional features, the massage device may comprise an acoustic and/or optical switch and/or regulator and be provided with a remote control.

In the shown example of execution, the energy supply consists of accumulators, which are arranged in a battery compartment in the housing 1, see FIG. 1. An operation with batteries is also possible, such as for instance commercial alkali batteries. The housing preferably comprises a separate battery reception chamber. The accumulators may either be removed from the battery compartment for recharging, or a charging device is connected by a detachable plug connection or the charging energy is transferred by an inductive bridge. A particularly advantageous improvement is that separate battery units, power supplies or solar cells may be assigned to the massage device.

The force for generating the movement of the massage device is formed in the vibration generator 2. Suitably, the positive-locked and friction-locked attachments of the vibration generator 2 are disposed at the housing 1, preferably by a mechanical attachment device, for instance by screw or adhesive connections.

In the shown example of execution, the housing 1 is made of plastic, which has, with regard to the intended use as a massaging rod, a sufficient rigidity. In the housing wall are arranged the control elements 12, 13. The energy supply is suitably accommodated in a separate battery compartment, which has a re-closable opening in the housing 1. In the shown example of execution, the battery compartment is configured such that every single battery 4 comprises a holder. The housing 1 carries the electronic control system 3, in which the printed-circuit board is mechanically held in the interior of the housing. Particularly advantageous improvements are among others that the housing 1 a receives a conventional coating of a soft material, and that conventional vibrators (rotating unbalanced mass) are additionally included. Furthermore, the energy supply is arranged in the housing 1 such that the battery compartment does not have any openings and thus a water-tight design is obtained.

For achieving an optimum massage result, various shaped pieces can be arranged on the housing 1, differing by the surface texture. The surface texture may be from smooth, slightly ribbed to nubbed and is based on commercially available designs of respective massage devices. As material for the shaped pieces, latex, skin-friendly silicone or any other soft-elastic material can be used.

To sum up, the advantages of the invention over prior art are listed in the following.

Some conventional devices generate vibrations of massage devices by arranging an (unbalanced) mass eccentrically to a motor-driven shaft. These usual vibrators permit due to the type of generation of vibrations caused by their construction by unbalanced masses driven by an electric motor only one kind of massage, which normally is based on movements directed radially to the longitudinal direction of the housing. In these devices, the movement components frequency and amplitude always depend from each other. The device presented here permits, due to the special vibration generator 2, an oscillating, axial movement of a massage device, wherein the movement components frequency and amplitude can be varied independently from each other. This permits, compared to conventional vibrators, a wide variety of ways of massaging.

The device presented here comprises because of the special vibration generator 2 a very small and compact construction and permits thus, compared to known external devices for generating oscillating, axial movements of dildoes, a position-independent application, so that an optimum massage effect coming closest to the natural sexual movements is achieved. Furthermore, the device produces little noise and permits the generation of most various axial movement patterns.

Due to the use of the special vibration generator 2, the force required for the generation of a movement of the massage device is produced by the acceleration of the internal magnetized armature 6, thus a coupling of the device with the environment not being necessary. Some conventional devices generate an axial movement at the connected dildo by that relative displacements between a fixed point, for instance the bed cover or the manual fixation by the user, and the device are caused. Thus, the device presented here for the oscillating, axial movement of the massage rod can be used in a more universal way with regard to the position-independent use and can further more easily be handled by the user.

In particular, the invention can be defined as follows:

1. A device 1 for the generation of oscillating, axial movements of a massage device, which can be used for the stimulation and massage of the erogenous zones, characterized by following features:

1.1 The device accommodated in a housing corresponding to the shape and the material of the various usual vibrator housings mainly consists of: a vibration generator 2, an electronic control system 3, control elements 12, 13 and an energy supply 4.

1.2 The force required for the generation of an oscillating, axial movement of the massage device is produced by the vibration generator 2 by that the magnetized armature 6 is axially accelerated in the tube 7 by the magnetic field generated by the coil 8, 9.

1.3 The coil(s) 8, 9 of the vibration generator 2 is (are) addressed by the electronic control system 3 such that the generated movement of a massage device corresponds to the settings selected by the user by means of the control elements 12, 13.

2. The device as above, characterized by that for the generation of oscillating, axial movements of a massage device, a coil or several coils and one or several spring-damper elements 10, 11 are arranged at or in the tube 7, respectively, of the vibration generator 2. The tube 7 and the armature 6 have a round or angular cross section. In a housing 1 corresponding in its shape and material to the various usual vibrator housings, one or several vibration generators 2 are used.

3. The device as above, characterized by that the energy supply 4 for the electronic control system 3 and the vibration generator 2 consists of batteries, accumulators, solar cells, a power supply or the like, which can be accommodated in the housing of the massage device. A charging device for charging the accumulator may be assigned to the energy supply.

4. The device as above, characterized by that the coil(s) 8, 9 of the vibration generator 2 is (are) addressed by the electronic control system 3 such that the kind of the oscillating, axial movement of a massage device is adjusted with regard to the frequency, the vibration amplitude and a combination of frequency and vibration amplitude with the control elements 12, 13 or further control elements.

5. The device as above, characterized by that the magnetized armature 6 is a permanent magnet or a metal rod magnetized by one or several coils and electrical energy.

6. The device as above, characterized by that the electronic control system 3 is activated by an acoustic and/or optical switch and/or regulator. Operation of the device may also be made by a remote control.

7. The device as above, characterized by that the coil(s) 8, 9 of the vibration generator 2 is (are) addressed by the electronic control system 3 such that the generated oscillating, axial movement of a massage device is automatically adjusted according to the optimum frequency (for instance natural frequency), the maximum vibration amplitude, an energy-optimized movement, a random movement or the like.

The invention claimed is:

1. A massage device comprising:

a device housing, an electromechanical arrangement disposed in the device housing for generating mechanical vibrations, an electronic controller for controlling the electromechanical arrangement for generating mechanical vibrations, and a power source, electrically coupled to the electromechanical arrangement and the electronic controller, wherein the electromechanical arrangement includes at least one coil element, at least one magnetic core arranged coaxial within the at least one coil element and movably guided parallel to a cylinder axis of the at least one coil element, wherein the at least one magnetic core has a mass m1 and the massage device has a total mass m2, wherein a mass ratio m1:m2 is in the range from 1:100 to 1:3, and wherein a cylindrical member is provided in which the at least one magnetic core is movably guided, wherein the cylindrical member includes an end magnet at each end thereof, wherein the magnetic polarity of an inner face of each of the end magnets is opposite to the magnetic polarity of an end face of the at least one magnetic core which faces the inner face of a respective end magnet.

2. The massage device according to claim 1, wherein the electronic controller activates the electromechanical arrangement to generate mechanical vibrations with a frequency in the range from 0.3 to 5 Hz.

3. The massage device according to claim 1, wherein the at least one magnetic core is guided in the device housing to move essentially inaudibly.

4. The massage device according to claim 1, wherein a form of the device housing is of essentially cylindrical, spherical, conical, or cylindrical with one or more neckings, shape.

5. The massage device according to claim 1, wherein the device housing includes an overcoat made of a physiologically compatible material.

6. The massage device of claim 5, wherein the overcoat is made from silicone, latex, polyolefines, synthetic polyisoprene, polyurethane, nitrile rubber, synthetic resin AT-10, hydrogel, or natural casing.

7. The massage device according to claim 1, wherein the power source is an accumulator.

8. The massage device according to claim 7, wherein the electronic controller additionally comprises an electronic charging circuit for the accumulator.

9. The massage device according to claim 8, wherein the electronic charging circuit for the accumulator is provided externally as a separate charging device.

10. The massage device according to claim 9, wherein the electronic charging circuit is electrically connected to the massage device by a charging lead, wherein the charging lead comprises a contacting member, which is reversibly connectable with charging contacts arranged on or in a surface of the massage device.

11. The massage device according to claim 9 wherein the electronic charging circuit is inductively connected to the massage device by an inductive power transmitter, wherein the charging lead comprises an inductive power receiver, which is reversibly introducible into an inductive field of the inductive power transmitter.

12. The massage device according to claim 1, wherein the power source is a battery.

13. The massage device according to claim 1, wherein the power source is a mains adaptor, and wherein the mains adaptor comprises a detachable or permanent mains line for connecting to a mains socket.

14. The massage device according to claim 1, wherein the cylindrical member is made of a synthetic organic polymer, a metal with a magnetic permeability of less than 3 $V*s*A^{-1}*m^{-1}$, or a paper or cardboard material.

15. The massage device according to claim 5, wherein the total mass m2 of the massage device comprises the masses of the device housing, of the electromechanical arrangement, of the electronic controller, of a battery or accumulator, and of the overcoat.

16. The massage device according to claim 1, wherein at least a part of an outer surface of the device housing has a topography comprising riffles or ripples.

17. The massage device according to claim 5, wherein at least a part of an outer surface of the overcoat has a topography comprising riffles.

18. The massage device according to claim 1, wherein at least the electromechanical arrangement, the electronic controller, and the power source comprised therein are located in waterproof compartments, and wherein a battery or an accumulator serving as the power source is located in a separate waterproof compartment located within the massage device.

19. The massage device according to claim 1, wherein the electronic controller comprises a memory circuit, into which different programs with respect to different amplitudes and/or frequencies of the at least one magnetic core are stored.

20. The massage device of claim 19, wherein the electronic controller comprises a control member which is operatively coupled to the memory circuit to activate different programs upon actuation of the control member.

21. The massage device of claim 19, further comprising two control members for independent variation of a frequency and an amplitude of mechanical vibrations of the at least one magnetic core.

22. The massage device of claim 21, wherein each control member is a pushbutton, which is operatively connected to a control assembly to vary the frequency and/or amplitude of vibrations of the at least one magnetic core upon repeated actuations of the pushbutton.

23. The use of a massage device according to claim 1, for sexual stimulation comprising: switching on the massage device; and bringing the massage device into contact with a sexually stimulable body part of a person.

24. A massage device comprising:

a device housing, an electromechanical arrangement disposed in the device housing for generating mechanical vibrations, an electronic controller for controlling the electromechanical arrangement for generating mechanical vibrations, and a power source, electrically coupled to the electromechanical arrangement and the electronic controller, wherein the electromechanical arrangement includes at least one coil element, at least one magnetic core arranged coaxial within the at least one coil element and movably guided parallel to a cylinder axis of the at least one coil element, wherein the at least one magnetic core has a mass m1 and the massage device has a total mass m2, wherein a mass ratio m1:m2 is in the range from 1:100 to 1:3, and further comprising at least one control assembly operatively coupled to the electronic controller to adjustably control a frequency and/or amplitude of mechanical vibrations of the at least one magnetic core.

25. The massage device of claim 24, wherein the at least one control assembly is a wireless or wire-bound remote control assembly.

26. The massage device of claim 24, wherein the at least one control assembly comprises at least one control member located on or in a surface of the device housing, which is operatively coupled to the electronic controller to vary the frequency and/or amplitude upon actuations of the at least one control member.

27. A massage device comprising a device housing, an electromechanical arrangement disposed in the device housing for generating mechanical vibrations, an electronic controller for controlling the electromechanical arrangement for generating mechanical vibrations, and a power source, electrically coupled to the electromechanical arrangement and the electronic controller, wherein the electromechanical arrangement includes a cylindrical member and linear actuator comprising a stator and a moveable and permanently magnetized core, wherein the core is movably guided parallel to a cylinder axis of the housing and wherein the stator is operatively controlled by the electronic controller to effect the core to sway back and forth between two end points of linear movement periodically, wherein in operation, the massage device as a whole vibrates in a direction substantially parallel to a cylinder axis of the cylindrical member, and wherein the core has a mass m1 and the massage device has a total mass m2, wherein a mass ratio m1:m2 is in the range from 1:100 to 1:3.

28. The use of a massage device according to claim 27 for sexual stimulation comprising: switching on the massage device; and bringing the massage device into contact with a sexually stimulable body part of a person.

29. A massage device comprising:

a device housing, an electromechanical arrangement disposed in the device housing for generating mechanical vibrations, an electronic controller for controlling the electromechanical arrangement, and a power source, electrically coupled to the electromechanical arrangement and the electronic controller, wherein the electromechanical arrangement includes at least one coil element and at least one ferromagnetic core, wherein the at least one ferromagnetic core has a mass m1 and the massage device a total mass m2, wherein a mass ratio m1:m2 is in the range from 1:100 to 1:3, and wherein the electromechanical arrangement further comprises:

a cylindrical member, in which the at least one ferromagnetic core is guided parallel to a cylindrical member axis;

the at least one coil element having a coil axis arranged coaxial with the cylindrical member and surrounding the cylindrical member; and one impact element located at each end of the cylindrical member, wherein the impact element located at each end of the cylindrical member effects a repulsive force on a face of the corresponding at least one ferromagnetic core facing the impact element.

30. The use of a massage device according to claim 29 for sexual stimulation comprising: switching on the massage device; and bringing the massage device into contact with a sexually stimulable body part of a person.

31. A massage device comprising a device housing, an electromechanical arrangement disposed in the device housing for generating mechanical vibrations, an electronic controller for controlling the electromechanical arrangement for generating mechanical vibrations, and an accumulator, electrically coupled to the electromechanical arrangement and the electronic controller, wherein the electronic controller additionally comprises an electronic charging circuit for the accumulator, which is provided externally as a separate charging device, said electronic charging circuit being electrically connected to the massage device by a charging lead, wherein the charging lead comprises a contacting member, which is reversibly connectable with charging contacts arranged on or in a surface of the massage device, wherein the electromechanical arrangement includes at least one coil element, at least one magnetic core arranged parallel or coaxial with the at least one coil element and movably guided parallel to a cylinder axis of the housing, and wherein the at least one core has a mass m1 and the massage device has a total mass m2, wherein a mass ratio m1:m2 is in the range from 1:100 to 1:3.

32. A method of driving a massage device comprising the steps of:

driving a cylindrical member along a cylinder axis that is parallel to an outer housing of the massage device in a first direction using a linear actuator that includes a stator, a moveable magnetic core and the cylindrical member, wherein the magnetic core is movably guided parallel to the cylinder axis;

driving the cylindrical member along the cylinder axis that is parallel to the outer housing in a second direction using the linear actuator; and outputting drive signals from an electronic controller to the stator to cause the cylindrical member to move along a portion of a length of the outer housing at a rate that will cause the outer housing to move in response to the cylindrical member moving back and forth between two end points of linear movement within the outer housing, causing the massage device in operation to vibrate in a direction substantially parallel to the cylinder axis of the cylindrical member, wherein the magnetic core has a mass m1 and the massage device has a total mass m2, wherein a mass ratio m1:m2 is within the range from 1:100 to 1:3.

33. The method of claim 32 wherein the mass ratio m1:m2 is within the range from 1:10 to 1:3.

34. The method of claim 32 wherein the mass m1 is within the range from 10 to 300 g.

35. The method of claim 32 wherein the mass m2 is within the range from 100 to 1,000 g.

36. The method of claim 32 further comprising generating mechanical vibrations with a frequency in the range from 0.3 to 5 Hz.

37. The method of claim 32 further comprising generating mechanical vibrations with a frequency in the range from 0.3 to 10 Hz and an amplitude of vibration in the range from 5 to 50 mm.

38. The method of claim 32 further comprising the step of providing an end magnet at each end of the cylindrical member, wherein the magnetic polarity of an inner face of each of the end magnets is opposite to the magnetic polarity of an end face of the magnetic core which faces the inner face of a respective end magnet.

39. The method of claim 32, wherein the total mass m2 of the massage device comprises the masses of the outer housing, of the linear actuator, of the electronic controller, of a battery or accumulator, and of an overcoat on the outer housing.

40. The method of claim 32, further comprising the step of adjustably controlling a frequency and/or amplitude of mechanical vibrations of the magnetic core using the electronic controller.

41. The method of claim 40, further comprising varying the frequency and/or amplitude of the mechanical vibrations of the magnetic core using repeated actuations of a pushbutton.

* * * * *